US006274984B1

(12) United States Patent
Hochi et al.

(10) Patent No.: US 6,274,984 B1
(45) Date of Patent: Aug. 14, 2001

(54) HIGH-FREQUENCY ENERGY SUPPLY MEANS, AND A HIGH-FREQUENCY ELECTRODELESS DISCHARGE LAMP DEVICE USING SIDE RESONATOR COUPLING

(75) Inventors: Akira Hochi, Nara; Mamoru Takeda, Kyoto, both of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/201,295

(22) Filed: Nov. 30, 1998

Related U.S. Application Data

(63) Continuation-in-part of application No. 08/961,300, filed on Oct. 30, 1997, now Pat. No. 6,049,170.

(30) Foreign Application Priority Data

Nov. 28, 1997 (JP) ..... 9-327776

(51) Int. Cl.[7] ..... H01J 65/04
(52) U.S. Cl. ..... 315/39; 315/248; 333/230
(58) Field of Search ..... 315/39, 248; 333/230

(56) References Cited

U.S. PATENT DOCUMENTS

| | | | |
|---|---|---|---|
| 4,749,915 | 6/1988 | Lynch et al. | 315/248 |
| 4,792,732 | 12/1988 | O'Loughlin | 315/334 |
| 4,954,755 | 9/1990 | Lynch et al. | 315/248 |
| 5,144,206 | 9/1992 | Butler et al. | 315/248 |
| 5,227,698 | 7/1993 | Simpson et al. | 315/248 |
| 5,280,252 | 1/1994 | Inoue et al. | 315/5.41 X |
| 5,451,847 | 9/1995 | Nakanishi | 315/505 |
| 5,498,928 | 3/1996 | Lapatovich et al. | 315/39 |

FOREIGN PATENT DOCUMENTS

| | | |
|---|---|---|
| 0684629 | 11/1995 | (EP) . |
| 54-082876 | 7/1979 | (JP) . |
| 1-149337 | 6/1989 | (JP) . |
| 5-326193 | 12/1993 | (JP) . |
| 7-211500 | 8/1995 | (JP) . |
| 7-302700 | 11/1995 | (JP) . |
| 7-326499 | 12/1995 | (JP) . |
| 8-17597 | 1/1996 | (JP) . |
| 63-53898 | 3/1998 | (JP) . |
| 10-189270 | 7/1998 | (JP) . |

OTHER PUBLICATIONS

European Search Report, application No. 98122476.9, dated Nov. 18, 1999.
Japanese Office Action dated Mar. 21, 2001.

*Primary Examiner*—Benny T. Lee
(74) *Attorney, Agent, or Firm*—Ratner & Prestia

(57) ABSTRACT

A high-frequency energy supply device has a group of side resonators which are electrically connected in a practically annular form, and supply high-frequency energy using resonant high-frequency electromagnetic fields generated in the center portion; and a plurality of high-frequency coupling part for coupling a plurality of high frequency energies propagated from a plurality of high-frequency propagation paths to said group of side resonators; wherein a plurality of high frequencies coupled to said group of side resonators from said plurality of high-frequency coupling means have phases and/or frequencies different from each other.

31 Claims, 10 Drawing Sheets

| Change with lapse of time in electric fields in x and y directions | Time [ns] (phase) | Direction of electric field |
|---|---|---|
| Electric field in x direction<br>Ex(arb.unit)<br>1, 0.5, −0.5, −1; t(ns) 0.1, 0.2, 0.3, 0.4<br>Electric field in y direction<br>Ey(arb.unit)<br>1, 0.5, −0.5, −1; t(ns) 0.1, 0.2, 0.3, 0.4<br>  <br> | 0.00<br>(0) |  <br> |
| | 0.10<br>($\pi/2$) |  <br> |
| | 0.20<br>($\pi$) |  <br> |
| | 0.31<br>($3\pi/2$) |  <br> |
| | 0.41<br>($2\pi$) |  <br> |

HIGH-FREQUENCY ENERGY SUPPLY MEANS, AND A HIGH-FREQUENCY ELECTRODELESS DISCHARGE LAMP DEVICE USING SIDE RESONATOR COUPLING

This application is a Continuation-In-Part (CIP) of application Ser. No. 08/961,300 filed on Oct. 30, 1997, now U.S. Pat. No. 6,049,170, issued Apr. 11, 2000.

BACKGROUND OF THE INVENTION

1. Field of the Invention

The present invention relates to a high-frequency energy supply means, and to a high-frequency electrodeless discharge lamp device.

2. Related Art of the Invention

A high-frequency electrodeless discharge lamp is more advantageous than arc-discharge lamps having electrodes in that electromagnetic energy is easily coupled to the filler, mercury can be eliminated from the filler for discharge emission, and higher luminous efficacy is expected because there is no loss due to the electrode. Since it has no electrodes within the discharge space, no blackening of the internal wall of the bulb occurs due to the evaporation of the electrodes. This extends the life of the lamp to a large extent. Because of these features, a high-frequency electrodeless discharge lamp has actively been studied in recent years as a high-intensity discharge lamp of the next generation.

Also in general discharge lamp devices, since ideal design for luminous intensity distribution can be achieved, by reducing the size of the light source to approach a point light source, the size reduction of plasma arc which is in a light source is strongly demanded. For example, when application to standard liquid crystal video projectors is considered, the size of the plasma arc of about 3 mm or less is required for the optical design for increasing the efficiency of utilization of light emission. In an electrodeless discharge lamp, on the other hand, the size of plasma arc is determined by the inner diameter of the bulb. However, since the size reduction of conventional high-frequency electrodeless discharge lamp devices using resonators are limited depending on wavelengths, they are not suited in application fields which require high-luminance point light sources. In recent years, therefore, a high-frequency energy supply means that can supply a high-frequency resonant electromagnetic field concentrated in a space smaller than the space to which a resonator supplies it has been developed.

Referring to FIG. 10, a technique will be described below based on "a high-frequency energy supply means and a high-frequency electrodeless discharge lamp device" disclosed in Japanese Patent Unexamined Publication No. 10-189270 (now U.S. Pat. No. 6,049,170).

The high-frequency energy supply means disclosed in Japanese Patent Unexamined Publication No. 10-189270 comprises a plurality of side resonators concurrently having an electromagnetic-inductive functional part produced from an annular conductive material and an electric-capacitive functional part consisting of gaps, and has a constitution to supply high-frequency energy required for discharge with the resonant high-frequency electromagnetic field at the center of the group of side resonators consisting of a plurality of annularly arranged side resonators so that the electric-capacitive functional part faces inward. Therefore, it is an object of the present invention to provide a high-frequency energy supply means that can supply a high-frequency resonant electromagnetic field concentrated in a space smaller than the space to which a resonator supplies it, and a high-frequency electrodeless discharge lamp device that uses such a high-frequency energy supply means.

As an example of groups of side resonators, FIG. 10 shows an 8-vane type resonator 102 comprising eight plate-like vanes 105 produced from a conductive material protruded toward the center from a cylinder 104 produced from the same conductive material. The surface of the internal wall of two adjacent vanes 105 and the cylinder 104, and the space produced in between act as the electromagnetic-inductive functional part, and the two protruded parts of vanes adjacent to each other and the gap between them act as the electric-capacitive functional part. An electrodeless discharge lamp 101 is positioned on the center portion of the 8-vane type resonators 102. The high-frequency energy propagated by the high-frequency oscillator means is coupled to the 8-vane type resonator 102 by an electric-field coupling type high-frequency coupling means 103 electrically connected to one of the vanes 105 by caulking or welding. The 8-vane type resonator 102 has been designed so as to resonate at the frequency of the high-frequency energy to be coupled. Thus, energy required for high-frequency discharge is supplied to the electrodeless discharge lamp 101 by the resonant high-frequency electric field E generated at the center portion of the 8-vane type resonator 102.

In particular, when the number of the side resonators is N, if the frequency of the high frequency or the shape of a side resonator is designed so that the group of side resonators is driven in the mode where the phase of a side resonator is shifted by $2\pi/N$ from the adjacent side resonator, the electric charge of a protruded part has the opposite polarity from the electric charge of the facing protruded part. The resonant high-frequency electric field E generated by this electric charge is oriented to the diameter direction of the center portion of the group of side resonators, and has distribution across the electrodeless discharge lamp 101. When the resonator is operated in the $2\pi/N$ mode, the strongest electric field is obtained at the center portion where the electrodeless discharge lamp 101 is placed.

The high-frequency coupling means may also be of a magnetic-field coupling type as shown in FIG. 11. In FIG. 11, the end portion of the loop antenna 113 is electrically connected to the cylindrical portion of the 8-vane type resonator 112. A resonant high-frequency electric field E is generated at the center portion of the 8-vane type resonator 112 by the high-frequency magnetic field oscillated from the loop antenna 113. High-frequency discharge energy is supplied to the electrodeless discharge lamp 111 by this resonant high-frequency electric field E.

By the high-frequency discharge energy supply means disclosed in Japanese Patent Application No. 10-189270, plasma arc as small as 10 mm or less may by produced and maintained even by high frequency of 2.45 GHz.

By the use of the above constitutions, however, since the direction of the electric fields is constant when operated in the $2\pi/N$ mode in order to obtain the strongest electric field, the mode is disturbed if the plasma is dislocated by thermal convection, and the discharge plasma often becomes unstable. Also, since the electric field is deflected in a certain direction, the thermal load of the electrodeless discharge lamp to the wall of the discharge tube deflects the direction of the electric field and is increased.

SUMMARY OF THE INVENTION

A high-frequency energy supply means of the present invention comprises a group of side resonators which are electrically connected in a practically annular form, and supply high-frequency energy using resonant high-frequency electromagnetic fields generated in the center portion; and a plurality of high-frequency coupling means for coupling a plurality of high frequency energies propagated from a plurality of high-frequency propagation paths to the group of side resonators; wherein a plurality of high frequencies coupled to the group of side resonators from the plurality of high-frequency coupling means have phases and/or frequencies different from each other.

A high-frequency energy supply means of the present invention comprises a group of side resonators which are electrically connected in a practically annular form, and supply high-frequency energy using resonant high-frequency electromagnetic fields generated in the center portion; a high-frequency oscillator means; a high-frequency propagation means; a high-frequency dividing means for dividing the high frequency energy generated by the high-frequency oscillator means and propagated by said high-frequency propagation means to a plurality of propagation paths; a high-frequency phase-shifting means for shifting the phases of a plurality of high frequencies on the plurality of propagation paths into different phases; and a plurality of high-frequency coupling means for coupling the plurality of high frequency energies of different phases to the group of side resonators; wherein, when the number of the high-frequency coupling means is M, the smaller of the angles produced by the high-frequency coupling means adjacent to each other against the center of the ring formed by the group of side resonators is $\pi/M$; and the phases of high frequency energies coupled by said high-frequency coupling means adjacent to each other are shifted by $\pi/M$ from each other by the high-frequency phase-shifting means.

A high-frequency energy supply means of the present invention comprises a group of side resonators which are electrically connected in an annular form, and supply high-frequency energy using resonant high-frequency electromagnetic fields generated in the center portion; a high-frequency oscillator means; a high-frequency propagation means; a high-frequency dividing means for dividing the high-frequency energy generated by said high-frequency oscillator means and propagated by the high-frequency propagation means to a plurality of propagation paths; a high-frequency phase-shifting means for shifting the phases of a plurality of high frequency energies on the plurality of propagation paths into different phases; and a plurality of high-frequency coupling means for coupling said plurality of high frequency energies of different phases to the group of side resonators; wherein, when the number of said high-frequency coupling means is M, M is at least 3; the smaller of the angles produced by the high-frequency coupling means adjacent to each other against the center of the ring formed by the group of side resonators is $2\pi/M$; and the phases of high frequency energies coupled by the high-frequency coupling means adjacent to each other are shifted by $2\pi/M$ from each other by the high-frequency phase-shifting means.

A high-frequency energy supply means of the present invention comprises a group of side resonators which are electrically connected in an annular form, and supply high-frequency energy using resonant high-frequency electromagnetic fields generated in the center portion; a plurality of high-frequency oscillator means; a plurality of high-frequency propagation means; and a plurality of high-frequency coupling means for coupling the plurality of high frequency energies generated by the plurality of high-frequency oscillator means and propagated by the plurality of high-frequency propagation means to the group of side resonators; wherein the number of the plurality of high-frequency oscillator means is the same as the number of the plurality of high-frequency propagation means and the number of the plurality of high-frequency coupling means; the plurality of high-frequency coupling means are connected to different side resonators constituting the group of side resonators; and the frequencies of high frequencies generated by the plurality of high-frequency oscillator means are different from each other.

A high-frequency electrodeless discharge lamp device of the present invention comprises a high-frequency energy supply means according to the present invention, and an electrodeless discharge lamp, wherein the electrodeless discharge lamp is placed on the center of the ring of the high-frequency energy supply means, and discharge plasma is formed inside the discharge tube of the electrodeless discharge lamp by high-frequency energy supplied by the high-frequency energy supply means.

By the above constitution, the deflection of the electric fields to a certain direction is eliminated, resulting in the production and maintenance of stable discharge plasma, and the averaged thermal load of the electrodeless discharge lamp to the wall of the discharge tube.

The term "high frequency" used herein means electromagnetic waves having a frequency in a range between 1 MHz and 100 GHz. In particular, the present invention is advantageously practiced when the frequency is within the "microwave" range between 300 MHz and 30 GHz.

DETAILED DESCRIPTION OF THE PREFERRED EMBODIMENTS (Embodiment 1)

A first embodiment of a high-frequency energy supply means of the present invention will be described below referring to FIGS. 1 through 5.

Figure 1:
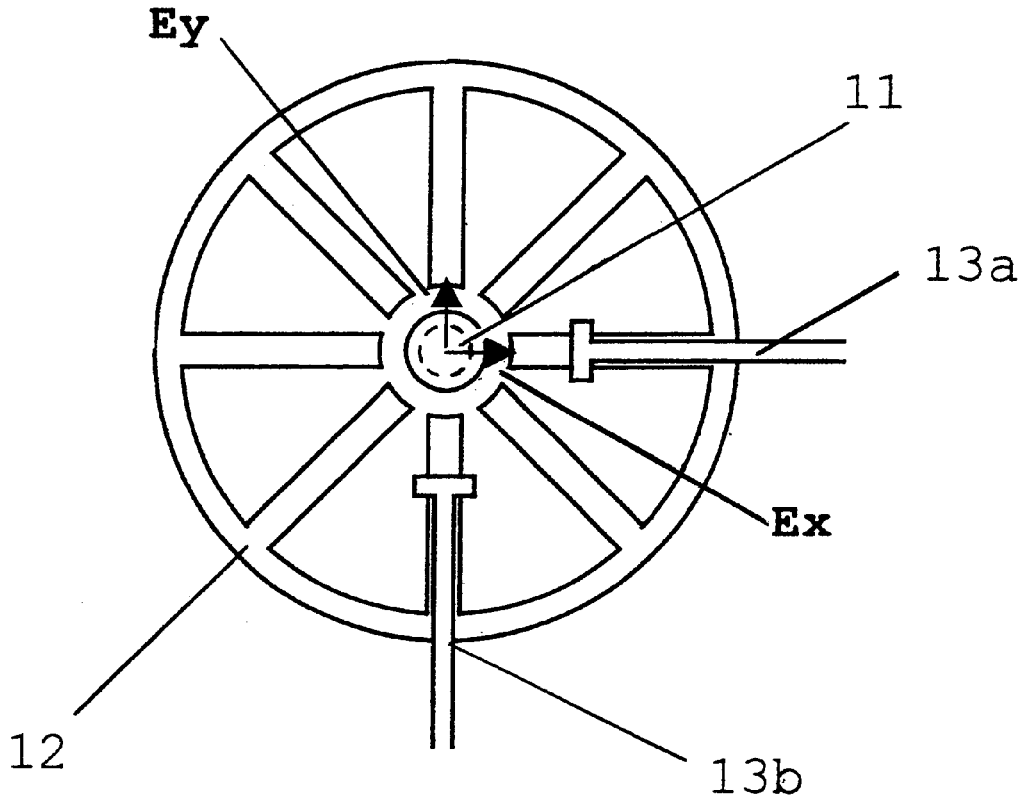
FIG. 1 is a diagram showing an 8-vane type resonator having two electric-field coupling type antennas according to a first embodiment of the present invention.

In the 8-vane type resonator 12 shown in FIG. 1, frequency and the shape of the resonators have been designed so that resonant high-frequency electric field passes across the electrodeless discharge lamp 11 placed at the center portion to obtain a strong electric field. That is, the frequency has previously been designed according to the frequency of the high-frequency energy to be coupled so that the resonators are operated in a mode where the phase of a side resonator is shifted by $\pi/4(2\pi/8)$, from the phase of the adjacent side resonator when high-frequency energy is coupled to the resonator 12 by a single high-frequency coupling means. Two electric-field coupling type antennas 13*a* and 13*b*, which are high-frequency coupling means, are connected to the 8-vane type resonator 12 so that the smaller angle of the angles against the center portion of the resonator is 90° ($\pi/2$). By the high-frequency energy coupled by the first electric-field coupling type antenna 13*a*, a resonant high-frequency electric field $E_x$ is generated in the center portion of the 8-vane type resonator 12 in the horizontal direction on FIG. 1. Similarly, by the high-frequency energy coupled by the second electric-field coupling type antenna 13*b*, a resonant high-frequency electric field $E_y$ is generated in the center portion of the 8-vane type resonator 12 in the vertical direction on FIG. 1.

Next, the constitution including a high-frequency oscillator means and a high-frequency dividing and phase-shifting means will be described referring to FIG. 2. The high-frequency energy oscillated from the high-frequency power source is propagated through a high-frequency propagation means consisting of coaxial line, a waveguide, and the like to a divider or a phase-shifter. The high-frequency energy propagated by said divider, which is a high-frequency dividing means, is divided to two portions. Furthermore, the two divided portions are set by the phase-shifter, which is a high-frequency phase-shifting means, so that the phase of the high frequency at the joint 23*a* of the first electric-field coupling type antenna 13*a* coupled to the 8-vane type resonator 22 (shown as 0° in FIG. 2) differs from the phase of the high frequency at the joint 23*b* of the second electric-field coupling type antenna 13*b* by 90° ($\pi/2$).

The electric field in the center portion of the above 8-vane type resonator at this time is given by Equation 1.

$$\begin{pmatrix} E_x \\ E_y \end{pmatrix} = \begin{pmatrix} E_0\cos\omega t \\ E_0\cos\left(\omega t + \frac{\pi}{2}\right) \end{pmatrix} \quad \text{[Equation 1]}$$

where ω represents the angular frequency of the input high frequency, t represents time, and $E_0$ represents the maximum value of resonant electric field coupled by each high-frequency coupling means. Equation 1 shows that the electric field in the center portion of an 8-vane type resonator rotates at the angular frequency o of the input high frequency signal.

Figure 2:
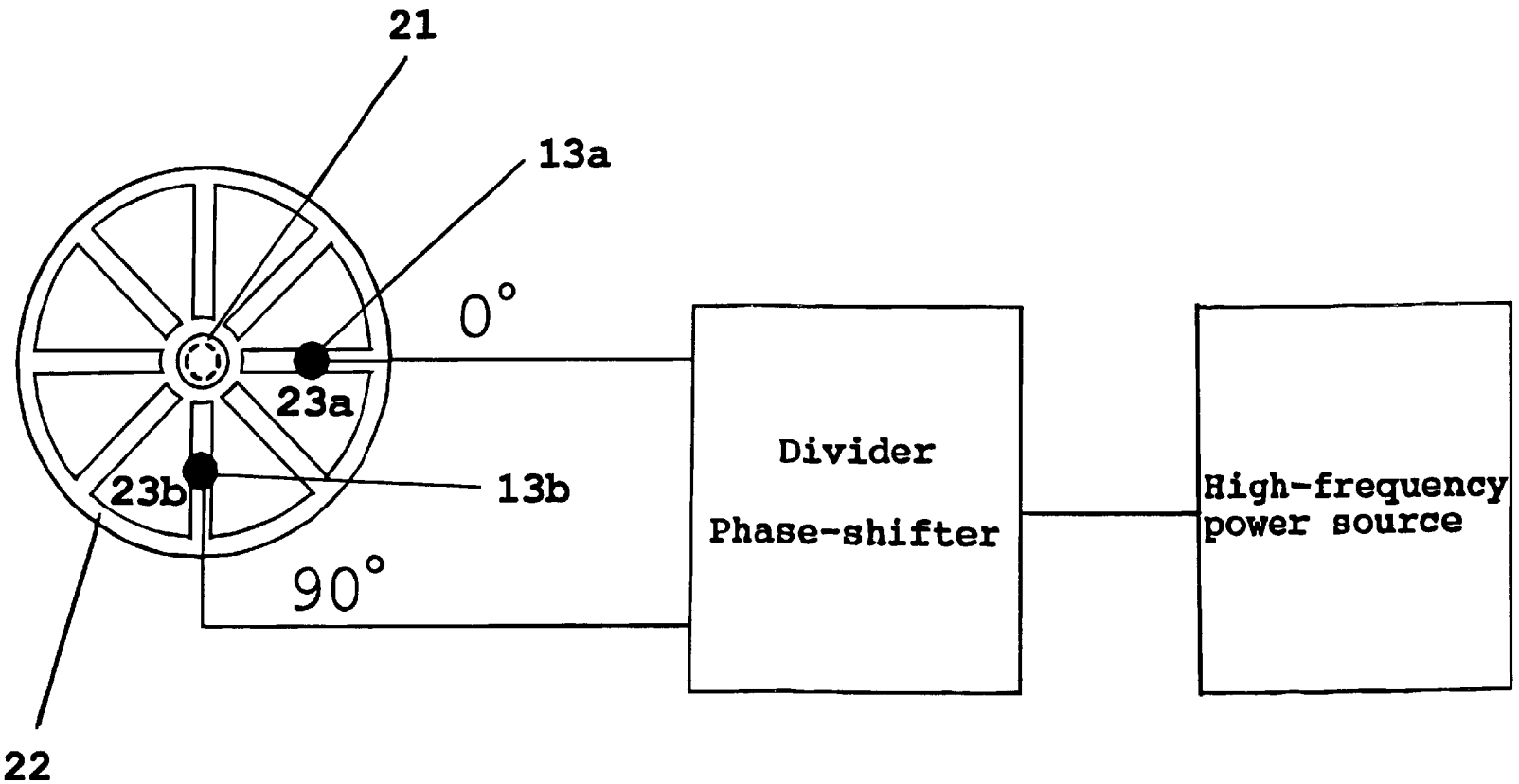
FIG. 2 is a schematic diagram showing a high-frequency electrodeless discharge lamp device which uses an 8-vane type resonator having two electric-field coupling type antennas according to a first embodiment of the present invention.
Figure 3:
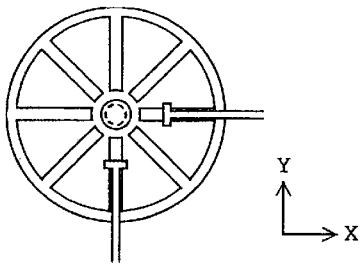
FIG. 3 is a diagram showing change with lapse of time in electric fields in a first embodiment of the present invention.
Figure 3:
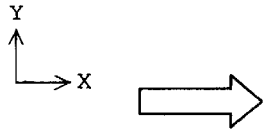
Figure 3:
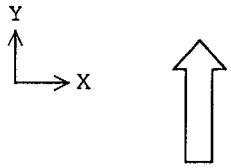
Figure 3:
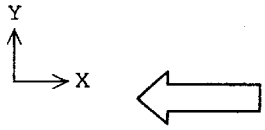
Figure 3:
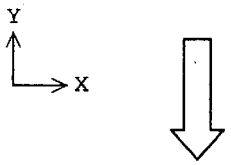
Figure 3:
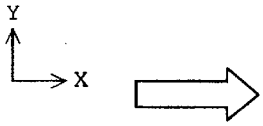

Change with lapse of time in resonant high-frequency electric fields at the center portions of 8-vane-type resonators 12 and 22 in which electrodeless discharge lamps 11 and 21 of FIGS. 1 and 2 are provided is shown in FIG. 3.

The high-frequency oscillator means oscillates in sinusoidal waves of 2.45 GHz, and change with lapse of time in the resonant high-frequency electric field in the x direction $E_x$ coupled by the first electric-field coupling antenna 13*a* is shown in the upper portion of the left column, and change with lapse of time in the resonant high-frequency electric field in the y direction $E_y$ coupled by the second electric-field coupling antenna 13*b* is shown in the lower portion of the left column. When the phase of the resonant high-frequency electric field in the x direction $E_x$ is shifted by 90° from the phase of the resonant high-frequency electric field in the y direction $E_y$, the electric fields overlapping on the center portion will rotate synchronizing with the frequency of the high frequency as shown by the arrows oriented at different directions in the right column.

Figure 4:
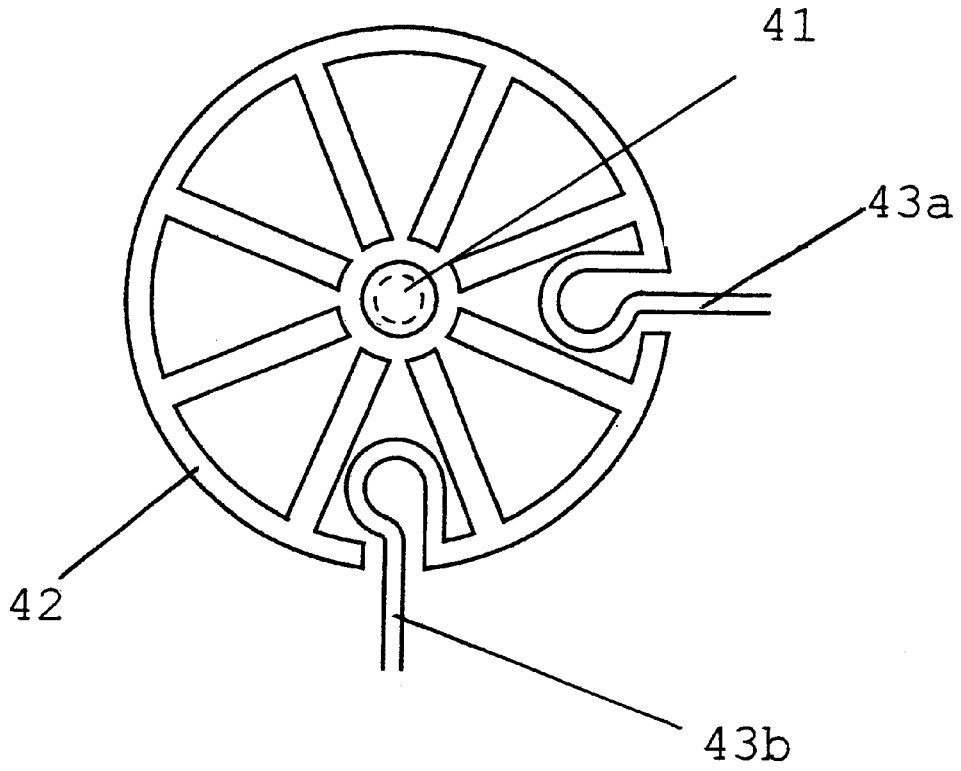
FIG. 4 is a diagram showing an 8-vane type resonator having two magnetic-field coupling type antennas according to a first embodiment of the present invention.

The high-frequency coupling means is not limited to the electric-field coupling type antenna as shown in FIG. 1, but the magnetic-field coupling type antenna as shown in FIG. 4 may be used. In FIG. 4, the end portions of two loop antennas 43*a* and 43*b* are electrically connected to the internal wall of the cylinder of the 8-vane type resonator 42, respectively. By two phase-shifting high-frequency magnetic fields oscillated for the loop antenna 43*a*, 43*b*, a resonant high-frequency rotating electric field is generated at the center portion of the 8-vane type resonator 42, and high-frequency energy is supplied to the electrodeless discharge lamp 41.

The constitution providing the above effect is not limited to the 8-vane type resonator and two high-frequency coupling means. For example, as FIG. 5 shows, a 6-vane type resonator and three high-frequency coupling means (at 0°, 60° and 120°) may be used.

Figure 5:
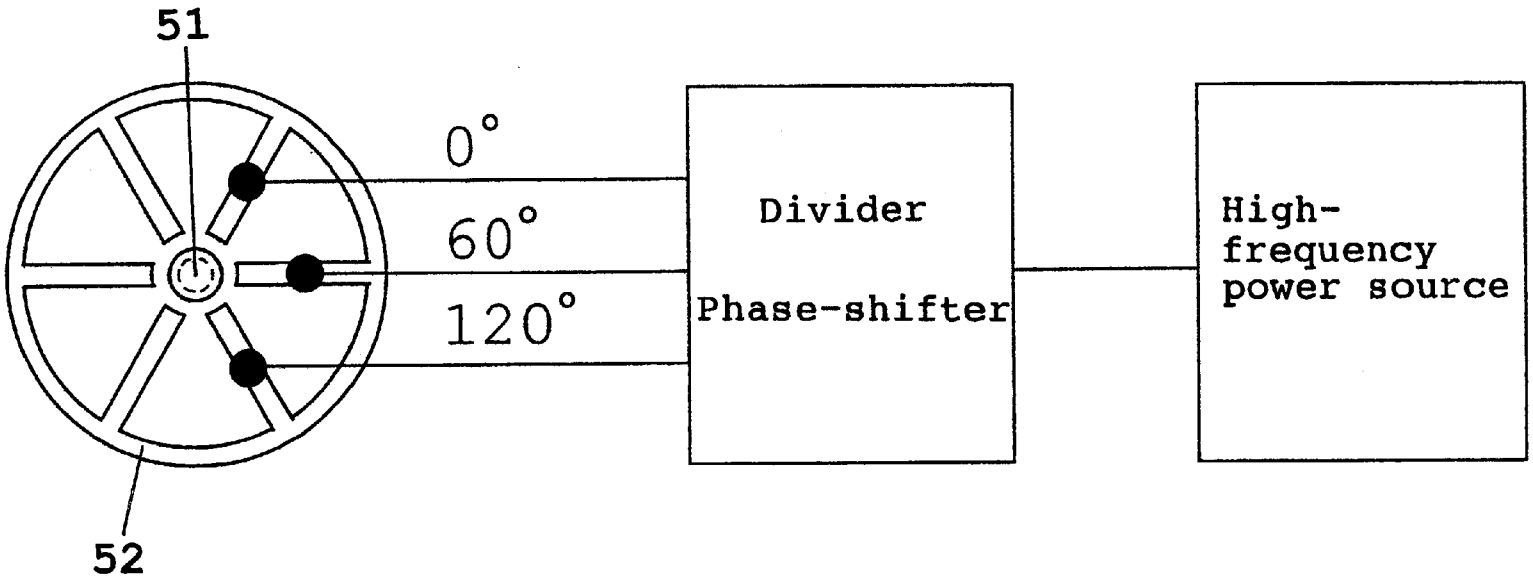
FIG. 5 is a schematic diagram showing a high-frequency electrodeless discharge lamp device which uses a 6-vane type resonator having three electric-field coupling type antennas according to a first embodiment of the present invention.

Here the 6-vane type resonator 52 shown in FIG. 5 has been designed to meet the frequency of the high-frequency energy to be coupled so as to operate in the $2\pi/3$ mode in which the resonant high-frequency electric field intersects the electrodeless discharge lamp 51 placed on the center portion, when the high-frequency energy is coupled by a single high-frequency coupling means.

Three joints of a high-frequency coupling means 52 are connected to a 6-vane type resonator consisting of six vanes so as to form an angle of 60° ($\pi/3$) to the center portion of the 6-vane type resonator 52. High-frequency energy generated by the high-frequency power source is propagated to the divider and the phase-shifter by a high-frequency propagation means comprising coaxial lines or waveguides. The high-frequency energy propagated by the above divider, which is a high-frequency divider means, is divided to three portions. Furthermore, the three divided portions are set by the phase-shifter, which is a high-frequency phase-shifting means, so that the phase of each high frequency at the three joints coupled to the 6-vane type resonator 52 differs from each other by 60° ($\pi/3$). By such a constitution, as in the constitution comprising the above 8-vane type resonator described above and two high-frequency coupling means, the resonant high-frequency electric field in the center portion of the 6 vane type resonator 52 can be rotated synchronizing with the frequency of the high frequency to be coupled, and the same effect can be obtained.

In the constitution of this embodiment described above, when the number of high-frequency coupling means is M, and the maximum values of the resonant electric field to be coupled with each high-frequency coupling means is equally $E_0$, the electric field in the center portion of the group of side resonators is given by Equation 2.

$$\begin{pmatrix} E_x \\ E_y \end{pmatrix} = \begin{pmatrix} E_0 \sum_{n=0}^{M-1} \left\{ \cos\left(\frac{n\pi}{M}\right) \cdot \cos\left(\omega t + \frac{n\pi}{M}\right) \right\} \\ E_0 \sum_{n=0}^{M-1} \left\{ \sin\left(\frac{n\pi}{M}\right) \cdot \cos\left(\omega t + \frac{n\pi}{M}\right) \right\} \end{pmatrix} \quad \text{[Equation 2]}$$

where ω represents the angular frequency of the input high frequency, and t represents time, as in Equation 1. However, when the number of side resonators constituting the group of side resonators is N, M is an integer of 2 or more and N/2 or less. Equation 2 indicates that the electric field at the center portion of the group of side resonators rotates at the angular frequency ω same as the frequency of the input high frequency.

By the above constitution, since the direction of the electric field is rotated without deflecting to one direction, the discharge plasma of the electrodeless discharge lamp and the heat distribution of the wall of the tube become uniform. By this, the disturbance of the mode of plasma due to thermal convection is less likely to occur, and the heat resistance of the electrodeless discharge lamp is improved.

(Embodiment 2)

A second embodiment of a high-frequency energy supply means of the present invention will be described below referring to FIGS. 6 and 7.

Figure 6:
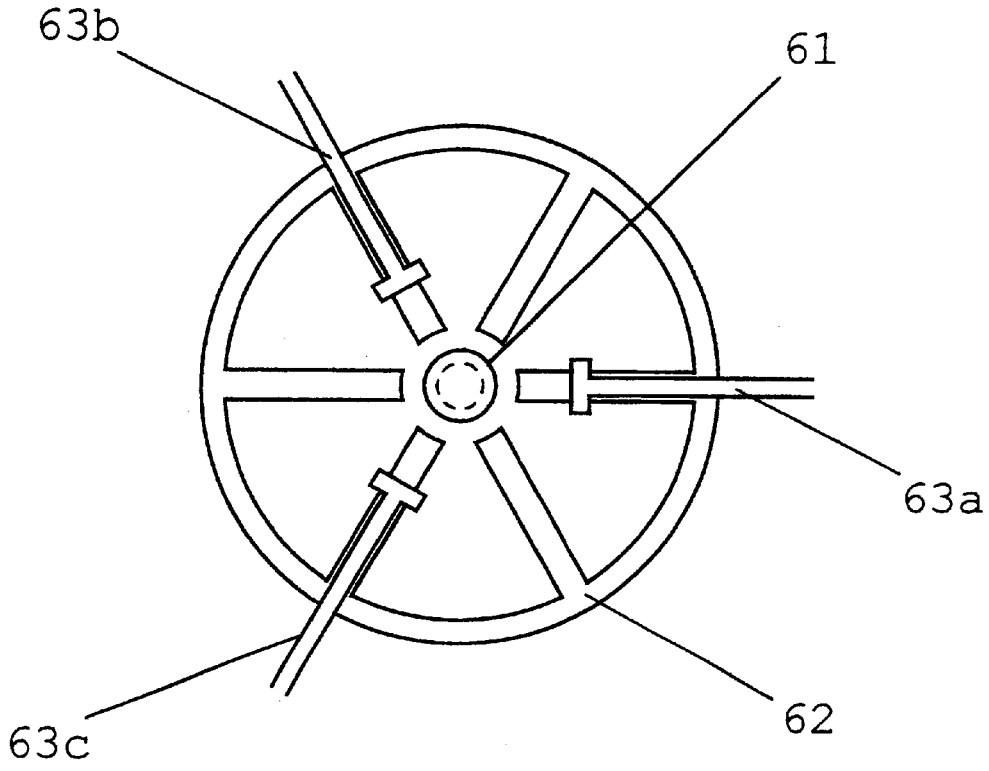
FIG. 6 is a diagram showing a 6-vane type resonator having three electric-field coupling type antennas according to a second embodiment of the present invention.
Figure 7:
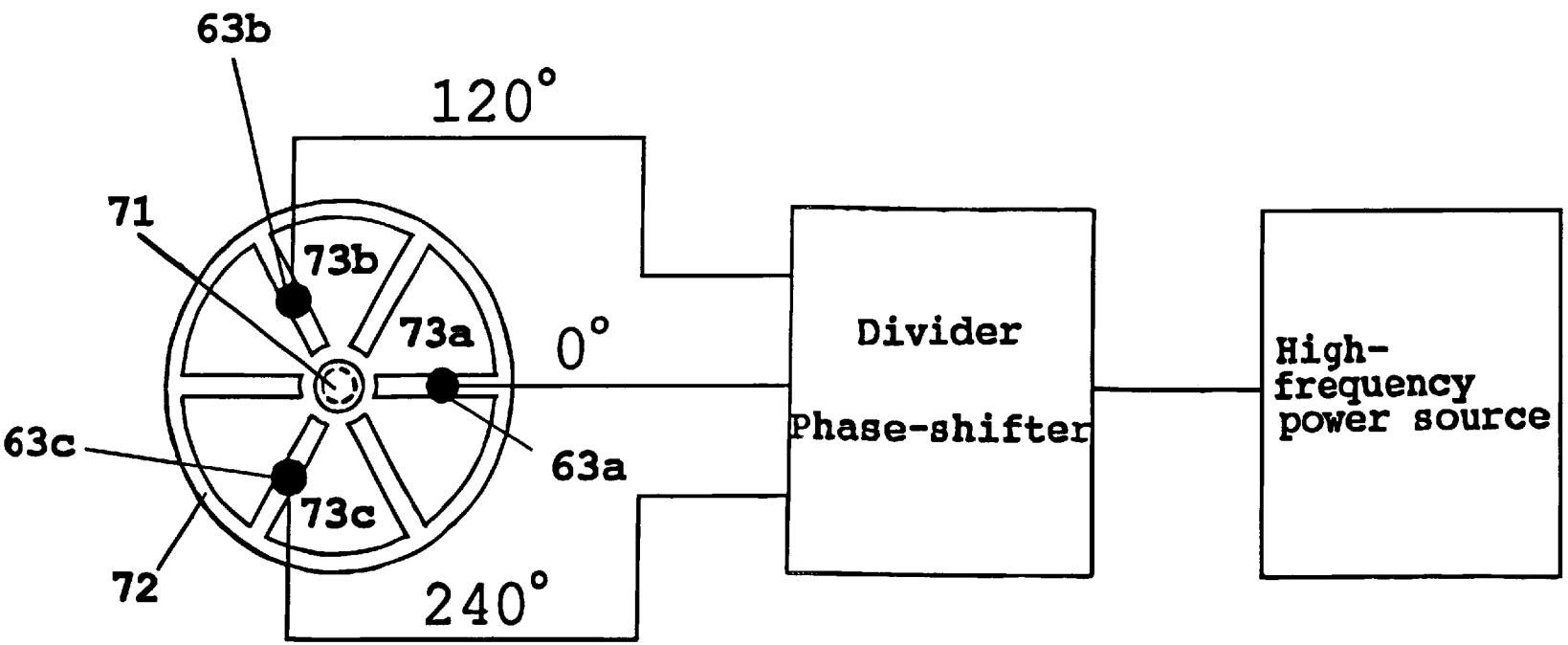
FIG. 7 is a schematic diagram showing a high-frequency electrodeless discharge lamp device which uses a 6-vane type resonator having three electric-field coupling type antennas according to a second embodiment of the present invention.

The 6-vane type resonator 62 shown in FIG. 6 has been designed to meet the frequency of the high-frequency energy to be coupled so as to operate in the 2π/3 mode in which the resonant high-frequency electric field intersects the electrodeless discharge lamp 61 placed on the center portion, when the high-frequency energy is coupled by a single high-frequency coupling means. Three electric-field coupling antennas 63*a*, 63*b* and 63*c*, which are high-frequency coupling means, are connected to the 6-vane type resonator 62, so as to form an angle of 120° (2π/3) against the center portion of the 6-vane type resonator 62.

Next, the constitution including a high-frequency oscillator means and a high-frequency dividing and phase-shifting means will be described referring to FIG. 7. The high-frequency energy oscillated from the high-frequency power source is propagated through a high-frequency propagation means consisting of coaxial line, a waveguide, and the like to a divider or a phase-shifter. The high-frequency energy propagated by said divider, which is a high-frequency dividing means, is divided to three portions. Furthermore, the three divided portions are set by the phase-shifter, which is a high-frequency phase-shifting means, so that the phase of the high frequency at the joint 73*a* (0°) of the first electric-field coupling type antenna 63*a* coupled to the 6-vane type resonator 72 differs from the phase of the high frequency at the joint 73*b* (120°) of the second electric-field coupling type antenna 63*b* and the phase of the high frequency at the joint 73*c* (240°) of the third electric-field coupling type antenna 63*c* by 120° (2π/3).

The electric field in the center portion of the above 6-vane type resonator which passes across electrodeless discharge lamp 71, is given by Equation 3.

$$\begin{pmatrix} E_x \\ E_y \end{pmatrix} = \begin{pmatrix} E_0 \cos\omega t + \cos\left(\frac{2\pi}{3}\right) \cdot E_0 \cos\left(\omega t + \frac{2\pi}{3}\right) + \cos\left(\frac{4\pi}{3}\right) \cdot E_0 \cos\left(\omega t + \frac{4\pi}{3}\right) \\ \sin\left(\frac{2\pi}{3}\right) \cdot E_0 \cos\left(\omega t + \frac{2\pi}{3}\right) + \sin\left(\frac{4\pi}{3}\right) \cdot E_0 \cos\left(\omega t + \frac{4\pi}{3}\right) \end{pmatrix} \quad \text{[Equation 3]}$$

where ω represents the angular frequency of the input high frequency, t represents time, and $E_0$ represents the maximum value of resonant electric field coupled by each high-frequency coupling means. Equation 3 shows that the electric field in the center portion of a 6-vane type resonator 72 rotates at the angular frequency o) same as the frequency of the input high frequency.

The constitution providing the above effect is not limited to the 6-vane type resonator and three high-frequency coupling means.

In the constitution of this embodiment described above, when the number of high-frequency coupling means is M, and the maximum values of the resonant electric field to be coupled with each high-frequency coupling means is equally $E_0$, the electric field in the center portion of the group of side resonators is given by Equation 4.

$$\begin{pmatrix} E_x \\ E_y \end{pmatrix} = \begin{pmatrix} E_0 \sum_{n=0}^{M-1} \left\{ \cos\left(\frac{2n\pi}{M}\right) \cdot \cos\left(\omega t + \frac{2n\pi}{M}\right) \right\} \\ E_0 \sum_{n=0}^{M-1} \left\{ \sin\left(\frac{2n\pi}{M}\right) \cdot \cos\left(\omega t + \frac{2n\pi}{M}\right) \right\} \end{pmatrix} \quad \text{[Equation 4]}$$

where ω represents the angular frequency of the input high frequency, and t represents time, as in Equation 3. However, when the number of side resonators constituting the group of side resonators is N, M is an integer of 3 or more and N or less. Equation 4 indicates that the electric field at the center portion of the group of side resonators rotates at the angular frequency ω same as the frequency of the input high frequency.

By the above constitution, since the direction of the electric field is rotated without deflecting to one direction as in the first embodiment, the discharge plasma of the electrodeless discharge lamp and the heat distribution of the wall of the tube become uniform. By this, the disturbance of the mode of plasma due to thermal convection is less likely to occur, and the heat resistance of the electrodeless discharge lamp is improved. In addition, since the electric field is overlapped also from the side opposed to the group of side resonators, compared with the first embodiment, the group of side resonators can be made to operate in the 2π/N mode more easily.

(Embodiment 3)

Figure 8:
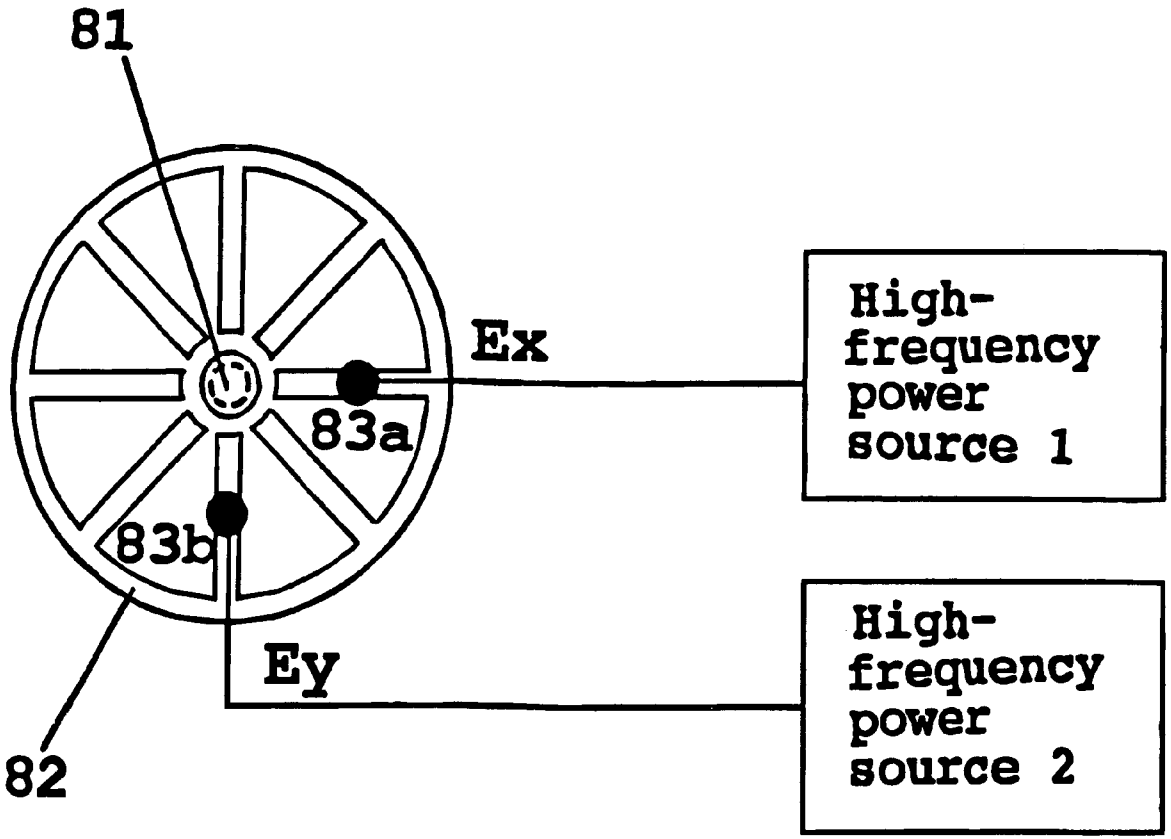
FIG. 8 is a schematic diagram showing a high-frequency electrodeless discharge lamp device which uses two high-frequency power sources according to a third embodiment of the present invention.

A third embodiment of a high-frequency energy supply means of the present invention will be described below referring to FIGS. 8 and 9.

A constitution of a high-frequency electrodeless discharge lamp device will be described which uses 8-vane type resonator each having two high-frequency oscillator means, two high-frequency propagation means, and two high-frequency coupling means referring to FIG. 8. The 8-vane type resonator 82, and two antennas 83*a* and 83*b*, which are high-frequency coupling means, are the same as those shown in FIG. 1 or FIG. 4 according to the first embodiment.

The high-frequency energy oscillated from the high-frequency power source 1 is propagated by the first high-frequency propagation means consisting of coaxial line, waveguides, and the like, and coupled to the part 83*a* of the 8-vane type resonator 82 by the first high-frequency coupling means. The high-frequency energy oscillated from the high-frequency power source 2 is propagated by the second high-frequency propagation means consisting of coaxial line, waveguides, and the like, and coupled to the part 83*b* of the 8-vane type resonator by the second high-frequency coupling means. By the high-frequency energy coupled by the first high-frequency coupling means 83*a*, a resonant high-frequency electric field $E_x$ is generated laterally in FIG. 8 at the center portion of the 8-vane type resonator 82. Similarly, by the high-frequency energy coupled by the second high-frequency coupling means 83*b*, a resonant high-frequency electric field $E_y$ is generated vertically in FIG. 8.

At this time, when the angular frequency of the high frequency oscillated from the high-frequency power source 1 is designated by $\omega_1$, and the angular frequency of the high frequency oscillated from the high-frequency power source 2 is designated by $\omega_2$, the x component and the y component of the electric field generated at the center portion of the 8-vane type resonator 82 are given by Equation 5.

$$\begin{pmatrix} E_x \\ E_y \end{pmatrix} = \begin{pmatrix} E_0\cos\omega_1 t \\ E_0\cos\omega_2 t \end{pmatrix} \quad \text{[Equation 5]}$$

where t represents time elapsed, and $E_0$ represents the maximum value of the resonant electric field coupled from each high-frequency coupling means. For example, when the angular frequency of the high frequency $\omega_2$ oscillated from the high-frequency power source 2 is 10% larger than the angular frequency of the high frequency $\omega_1$ oscillated from the high-frequency power source 1, Equation 5 is represented by Equation 6.

$$\begin{pmatrix} E_x \\ E_y \end{pmatrix} = \begin{pmatrix} E_0\cos\omega_1 t \\ E_0\cos(1.1\cdot\omega_1 t) \end{pmatrix} \quad \text{[Equation 6]}$$

Figure 9:
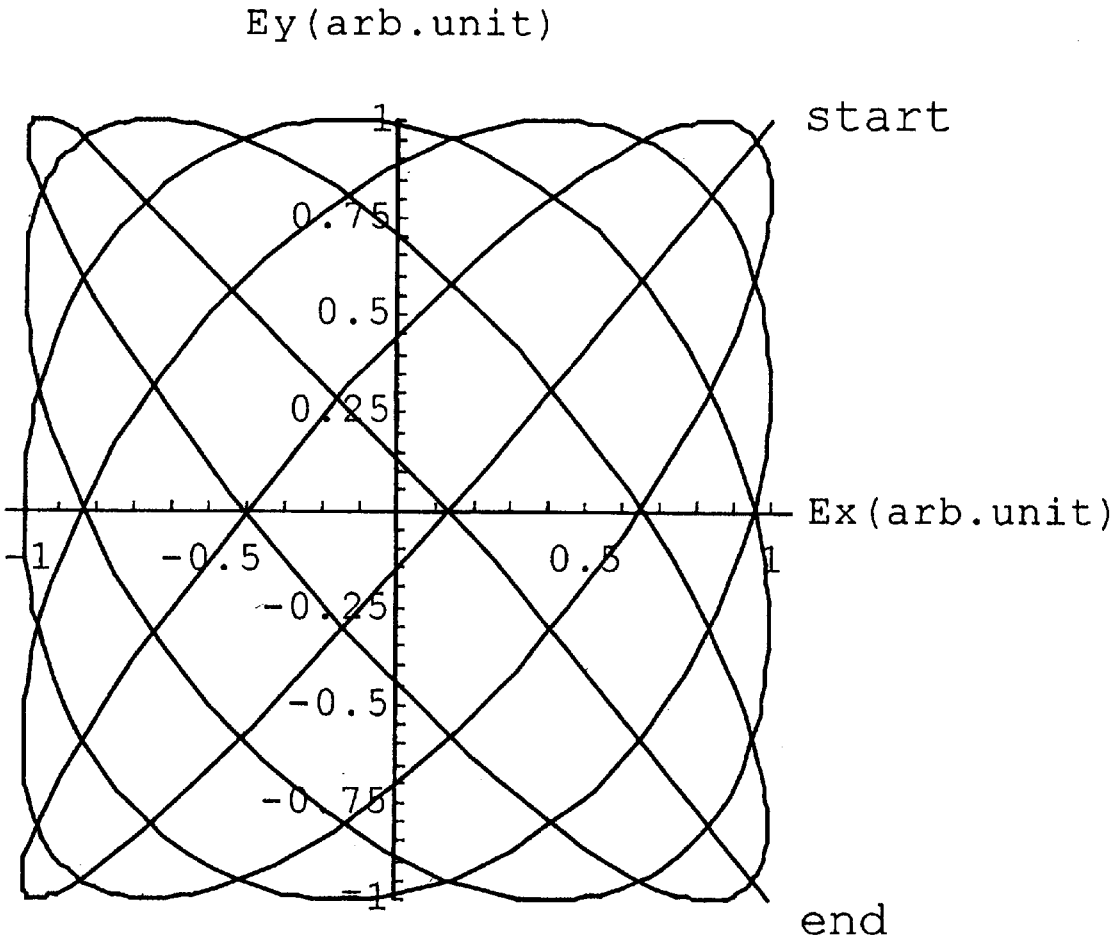
FIG. 9 is a graph showing a locus of change with lapse of time in electric fields in a third embodiment of the present invention.
Figure 10:
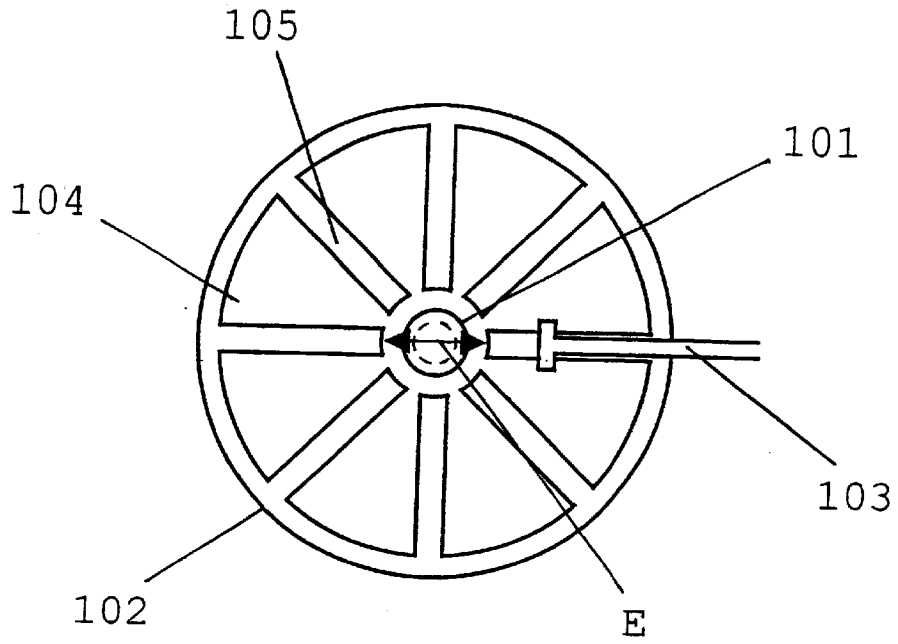
FIG. 10 is a diagram showing an 8-vane type resonator having an electric-field coupling type antenna.
Figure 11:
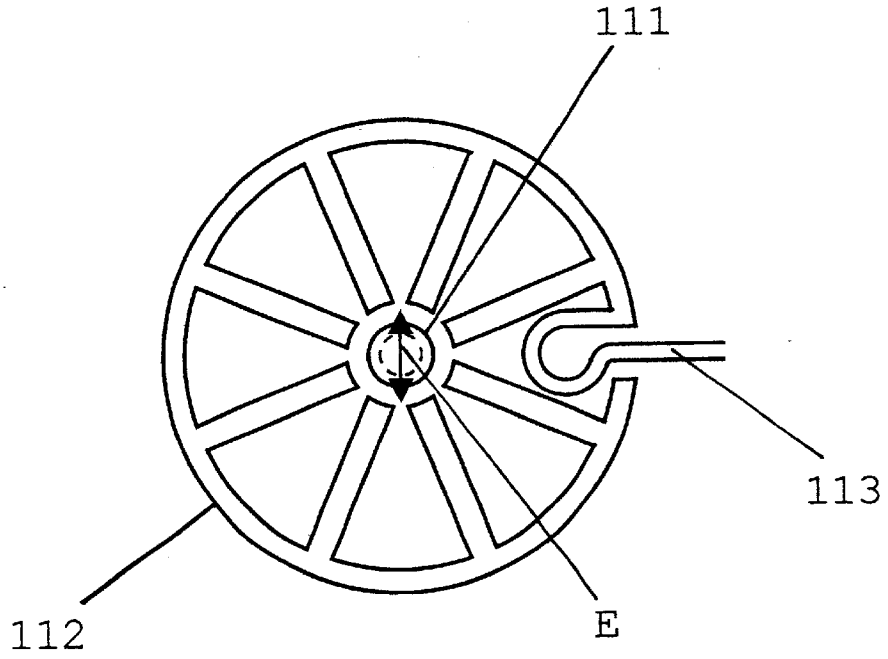
FIG. 11 is a diagram showing an 8-vane type resonator having a magnetic-field coupling type antenna.

The result of recording the locus of x and y components of the electric field generated at the center portion of the 8-vane type resonators 82 when the time t is varied until the high frequency oscillated from the high-frequency power source 1 travels 5 cycles ($0 \leqq \omega_2 t \leqq 10\pi$) is shown in FIG. 9.

When t=0, $E_x$ and $E_y$ are each 1, shown as "start" in FIG. 9. After traveling 5 cycles, Ex and Ey are 1 and −1, respectively, shown as "end" in FIG. 9.

When t is 0, the synthetic component of $E_x$ and $E_y$ which was in the obliquely upper right direction to the obliquely lower left direction is gradually shifted accompanying the shift of frequencies, and finally varied to the obliquely upper left direction from the obliquely lower right direction.

As described above, by differentiating the frequency of the high frequency oscillated from the high-frequency power source 1 from the frequency of the high frequency oscillated from the high-frequency power source 2, each of the synthetic components of the high-frequency electric field to be coupled by the 8-vane type resonators 82 repeats rotation due to the difference in frequencies.

By the above constitution, as in the first and second embodiments, since the direction of the electric field varies without deflecting to one direction, the discharge plasma of the electrodeless discharge lamp 81 (see FIG. 8) and the heat distribution of the wall of the tube become uniform. By this, the disturbance of the mode of plasma due to thermal convection becomes difficult to occur, and the heat resistance of the electrodeless discharge lamp 81 is improved. In addition, the rather delicate operation of the adjustment of phase difference is not required compared with the first and second embodiments.

Although an example using a 10% frequency difference is shown here, the frequency difference is of course not limited to 10%. More preferably, since each of the ISM (Industrial, Scientific, and Medical) frequency bands of high frequency, the use of which is allowed industrially, has a specific band width, frequency difference falls within such a band width. For example, the allowable band width in the ISM frequency band of the center frequency of 2.45 GHz is ±0.05 GHz. Therefore at this time, the frequency difference may be varied within the range of 0.1 GHz. In reality, since a high-frequency oscillator such as a magnetron always has an error in the oscillated frequency within the above allowable band width, the frequency difference is naturally obtained if a plurality of high-frequency oscillators are provided without efforts to change frequencies.

However, excessively large frequency difference is not preferred because it will be beyond the resonant frequency of the group of side resonators, or the occurrence of other resonance modes is considered. Therefore, it is preferred that the frequency difference is within the range of frequencies in which the same resonance mode can occur.

The constitution providing the above effect is not limited to the 8-vane type resonator each having two high-frequency oscillator means, two high-frequency propagation means, and two high-frequency coupling means.

For example, the constitution comprising three high-frequency oscillation means, three high-frequency propagation means, and three high-frequency coupling means may be constituted using a 6-vane type resonator and three high-frequency coupling means as shown in FIG. 5.

Although examples using vane type resonators as the groups of side resonators are shown in the above first to third embodiments, other groups of side resonators such as hole-slot type resonators may also be used.

Furthermore, in the above first to third embodiments, although the high-frequency energy supply means using the group of side resonators of the present invention is shown only in the aspect for application to a high-frequency electrodeless discharge lamp device, the application fields of the high-frequency energy supply means of the present invention are not limited thereto. For example, the high-frequency energy supply means of the present invention is also useful, when the supply of energy by resonant high-frequency electric fields concentrated and not deflected is required for forming a stable discharge plasma of a relatively small diameter, in devices utilizing high-frequency discharge such as plasma CVDs, plasma torches, and gas discharge lasers.

The high-frequency energy supply means of the present invention is also useful, when the supply of discharge energy by uniform resonant high-frequency electric fields concentrated and not deflected is required for heating, light emitting, melting, or evaporating of a work piece having a relatively small diameter placed on the center portion of the above high-frequency energy supply means using high-frequency energy.

In addition to the above, in the present invention, a plurality of high frequencies to be coupled by the high-frequency coupling means, and phase differences may be different from each other.

As described above, according to the present invention, uniform high-frequency energy can be supplied because the deflection of electric fields to one direction is eliminated, and the direction of the electric fields is rotated or periodically varied, compared with conventional microwave energy supply means using a group of side resonators.

By this, little disturbance of the mode of plasma due to thermal convection facilitates stable discharge plasma to be lit and maintained. Also, the thermal load to the wall of the discharge tube of an electrodeless discharge lamp is averaged, and the heat resistance of the electrodeless discharge lamp is improved.

Furthermore, the supply of energy for heating, light emitting, melting, or evaporating can be made uniform.

What is claimed is:

1. A high-frequency energy supply comprising a group of side resonators which are electrically connected in a substantially annular form, and supply high-frequency energies using resonant high-frequency electromagnetic fields generated in a center portion of the group of side resonators; and a plurality of high-frequency coupling means for coupling a plurality of high frequency energies propagated from a plurality of high-frequency propagation paths to said group of side resonators; wherein the plurality of high frequency energies coupled to said group of side resonators have phases and frequencies different from each other, and wherein said plurality of high frequency energies subject an object to one of discharge, heating, light emitting, melting and evaporating, said object being disposed in said center portion.

2. A high-frequency energy supply means according to claim 1, wherein there are two said high-frequency coupling means, and said two high-frequency coupling means are oriented at an angle other than 180 degrees.

3. A high-frequency energy supply means according to claim 1, wherein an angle produced between each of said side resonators against the center portion provided by said group of side resonators, when the number of said group of side resonators is N, is $2\pi/N$.

4. A high-frequency energy supply means according to claim 1, wherein, when the number of side resonators constituting said group of side resonators is N, the phase difference between adjacent ones of said side resonators is $2\pi/N$.

5. A high-frequency energy supply means according to claim 1, wherein said group of side resonators comprises vane-type resonators.

6. A high-frequency energy supply means according to claim 1, wherein said high-frequency coupling means are of either an electric-field coupler or a magnetic-field coupler.

7. A high-frequency energy supply comprising a group of side resonators which are electrically connected in a substantially annular form, and supply high-frequency energies using resonant high-frequency electromagnetic fields generated in a center portion of the group of side resonators; a high-frequency oscillator means; a high-frequency propagation means; a high-frequency dividing means for dividing said high frequency energy generated by said high-frequency oscillator means and propagated by said high-frequency propagation means to a plurality of propagation paths; a high-frequency phase-shifting means for shifting the phases of the divided high frequency energies into different phases; and a plurality of high-frequency coupling means for coupling said divided high frequency energies to said group of side resonators; wherein, when the number of said high-frequency coupling means is M, an angle produced between said high-frequency coupling means adjacent to each other against the center portion provided by said group of side resonators is $\pi/M$; and the phases of the divided high frequency energies coupled by said high-frequency coupling means adjacent to each other are shifted by $\pi/M$ from each other by said high-frequency phase-shifting means.

8. A high-frequency energy supply means according to claim 7, wherein the angel produced between each of said side resonators against the center portion provided by said group of side resonators, when the number of said group of side resonators is N, is $2\pi/N$.

9. A high-frequency energy supply means according to claim 7, wherein, when the number of side resonators constituting said group of side resonators is N, the phase difference between adjacent ones of said side resonators is $2\pi/N$.

10. A high-frequency energy supply means according to claim 7, wherein said high-frequency coupling means are of either an electric-field coupler or a magnetic-field coupler.

11. A high-frequency energy supply means according to claim 7, wherein said group of side resonators comprises vane-type resonators.

12. A high-frequency energy supply comprising a group of side resonators which are electrically connected in a substantially annular form, and supply high-frequency energies using resonant high-frequency electromagnetic fields generated in a center portion of the group of side resonators; a high-frequency oscillator means; a high- frequency propagation means; a high-frequency dividing means for dividing said high-frequency energy generated by said high-frequency oscillator means and propagated by said high-frequency propagation means to a plurality of propagation paths; a high-frequency phase-shifting means for shifting the phases of a plurality of high frequency energies on said plurality of propagation paths into different phases; and a plurality of high-frequency coupling means for coupling said plurality of high frequency energies of different phases to said group of side resonators; wherein, when the number of said high-frequency coupling means is M, M is at least 3; an angle produced between said high-frequency coupling means adjacent to each other against the center portion provided by said group of side resonators is $2\pi/M$; and the phases of high frequency energies coupled by said high-frequency coupling means adjacent to each other are shifted by $2\pi/M$ from each other by said high-frequency phase-shifting means.

13. A high-frequency energy supply means according to claim 12, wherein, when the number of side resonators constituting said group of side resonators is N, the phase difference between adjacent ones of said side resonators is $2\pi/N$.

14. A high-frequency energy supply means according to claim 12, wherein the angle produced between each of said side resonators against the center portion provided by said group of side resonators, when the number of said group of side resonators is N, is $2\pi/N$.

15. A high-frequency energy supply means according to claim 12, wherein said high-frequency coupling means are of either an electric-field coupler or a magnetic-field coupler.

16. A high-frequency energy supply means according to claim 12, wherein said group of side resonators comprises vane-type resonators.

17. A high-frequency energy supply comprising a group of side resonators which are electrically connected in a substantially annular form, and supply high-frequency energies using resonant high-frequency electromagnetic fields generated in a center portion of the group of side resonators; a plurality of high-frequency oscillator means; a plurality of high-frequency propagation means; and a plurality of high-frequency coupling means for coupling said plurality of high frequency energies from said plurality of high-frequency propagation means to said group of side resonators; wherein the number of said plurality of high-frequency oscillator means is the same as the number of said plurality of high-frequency propagation means and the number of said plurality of high-frequency coupling means; said plurality of high-frequency coupling means are connected to different side resonators constituting said group of side resonators; and the frequencies generated by said plurality of high-frequency oscillator means are different from each other, and wherein said plurality of high frequency energies subject an object to one of discharge, heating, light emitting, melting and evaporating, said object being disposed in said center portion.

18. A high-frequency energy supply means according to claim 17, wherein said group of side resonators comprises vane-type resonators.

19. A high-frequency energy supply means according to claim 17, wherein said high-frequency coupling means are of either an electric-field coupler or a magnetic-field coupler.

20. A high-frequency energy supply means according to claim 17, wherein the angle produced between each of said side resonators against the center portion provided by said group of side resonators, when the number of said group of side resonators is N, is $2\pi/N$.

21. A high-frequency energy supply means according to claim 17, wherein, when the number of side resonators constituting said group of side resonators is N, the phase difference between adjacent ones of said side resonators is $2\pi/N$.

22. A high-frequency energy supply means according to claim 17, wherein, when the number of said high-frequency coupling means is M, an angle produced between said high-frequency coupling means adjacent to each other against the center portion provided by said group of side resonators is $\pi/M$.

23. A high-frequency electrodeless discharge lamp device comprising a high-frequency energy supply including a group of side resonators which are electrically connected in a substantially annular form, and supply high-frequency energies using resonant high-frequency electromagnetic fields generated in a center portion of the group of side resonators; and a plurality of high-frequency coupling means for coupling a plurality of high frequency energies propagated from a plurality of high-frequency propagation paths to said group of side resonators; wherein the plurality of high frequency energies coupled to said group of side resonators have phases and frequencies different from each other, and wherein said plurality of high frequency energies subject an object to one of discharge, heating, light emitting, melting and evaporating, said object being disposed in said center portion; and the object is an electrodeless discharge lamp placed on the center portion, and wherein discharge plasma is provided inside a discharge tube of said electrodeless discharge lamp by high-frequency energy supplied by said high-frequency energy supply.

24. A high-frequency electrodeless discharge lamp device comprising a high-frequency energy supply including a group of side resonators which are electrically connected in a substantially annular form, and supply high-frequency energies using resonant high-frequency electromagnetic fields generated in a center portion of the group of side resonators; a high-frequency oscillator means; a high-frequency propagation means; a high-frequency dividing means for dividing said high frequency energy generated by said high-frequency oscillator means and propagated by said high-frequency propagation means to a plurality of propagation paths; a high-frequency phase-shifting means for shifting the ii phases of the divided high frequency energies into different phases; and a plurality of high-frequency coupling means for coupling said divided high frequency energies to said group of side resonators; wherein, when the number of said high-frequency coupling means is M, an angle produced between said high-frequency coupling means adjacent to each other against the center portion formed by said group of side resonators is $\pi/M$; and the phases of the divided high frequency energies coupled by said high-frequency coupling means adjacent to each other are shifted by $\pi/M$ from each other by said high-frequency phase-shifting means; and an electrodeless discharge lamp, wherein said electrodeless discharge lamp is placed on the center portion, and wherein discharge plasma is provided inside a discharge tube of said electrodeless discharge lamp by high-frequency energy supplied by said high-frequency energy supply.

25. A high-frequency electrodeless discharge lamp device comprising a high-frequency energy supply including a group of side resonators which are electrically connected in a substantially annular form, and supply high-frequency energies using resonant high-frequency electromagnetic fields generated in a center portion of the group of side resonators; a high-frequency oscillator means; a high-frequency propagation means; a high-frequency dividing means for dividing said high-frequency energy generated by said high-frequency oscillator means and propagated by said high-frequency propagation means to a plurality of propagation paths; a high-frequency phase-shifting means for shifting the phases of a plurality of high frequency energies on said plurality of propagation paths into different phases; and a plurality of high-frequency coupling means for coupling said plurality of high frequency energies of different phases to said group of side resonators; wherein, when the number of said high-frequency coupling means is M, M is at least 3; an angle produced between said high-frequency coupling means adjacent to each other against the center portion formed by said group of side resonators is $2\pi/M$; and the phases of high frequency energies coupled by said high-frequency coupling means adjacent to each other are shifted by $2\pi/M$ from each other by said high-frequency phase-shifting means; and an electrodeless discharge lamp, wherein said electrodeless discharge lamp is placed on the center portion, and wherein discharge plasma is provided inside a discharge tube of said electrodeless discharge lamp by high-frequency energy supplied by said high-frequency energy supply.

26. A high-frequency electrodeless discharge lamp device comprising a high-frequency energy supply including a group of side resonators which are electrically connected in a substantially annular form, and supply high-frequency energies using resonant high-frequency electromagnetic fields generated in a center portion of the group of side resonators; a plurality of high-frequency oscillator means; a plurality of high-frequency propagation means; and a plurality of high-frequency coupling means for coupling said plurality of high frequency energies from said plurality of high-frequency propagation means to said group of side resonators; wherein the number of said plurality of high-frequency oscillator means is the same as the number of said plurality of high-frequency propagation means and the number of said plurality of high-frequency coupling means; said plurality of high-frequency coupling means are connected to different side resonators constituting said group of side resonators; and the frequencies generated by said plurality of high-frequency oscillator means are different from each other, and wherein said plurality of high frequency energies subject an object to one of discharge, heating, light emitting, melting and evaporating, said object being disposed in said center portion; and the object is an electrodeless discharge lamp placed on the center portion, and wherein discharge plasma is provided inside a discharge tube of said electrodeless discharge lamp by high-frequency energy supplied by said high-frequency energy supply.

27. A high frequency energy supply comprising:

a conductive cylindrical structure, a plurality of conductive plates disposed within said cylindrical structure having first ends of said plates connected to said structure and second ends of said plates orthogonally branching away from said structure to provide a gap at a center portion of said structure, said plates distributed equidistantly from each other by an angle of $2\pi/N$ from said center, where N is the number of plates, a plurality of couplers each coupling high frequency energy into said conductive cylindrical structure for forming a periodically varying electric field which overlaps said center portion, said plurality of couplers disposed inside of said conductive cylindrical structure, and an object placed in the gap, wherein the varying electric field subjects the object to one of discharge, heating, light emitting, melting and evaporating.

28. The high frequency energy supply of claim 27 wherein said varying electric field is provided between said center and said second end of each plate.

29. The high frequency energy supply of claim 27 wherein each of said plurality of plates has a high frequency energy differing in phase relationship by $\pi/M$ from a high frequency energy of an adjacent plate, where M is the number of high frequency energies.

30. The high frequency energy supply of claim 27 wherein each of said high frequency energies is of a different frequency.

31. A high frequency electrodeless discharge lamp comprising the high frequency energy supply according to claim 27 and an electrodeless discharge lamp disposed within said gap, wherein a discharge plasma is provided inside said lamp by said high frequency energies.

* * * * *

UNITED STATES PATENT AND TRADEMARK OFFICE

CERTIFICATE OF CORRECTION

PATENT NO. : 6,274,984 B1
DATED : August 14, 2001
INVENTOR(S) : Akira Hochi et al.

It is certified that error appears in the above-identified patent and that said Letters Patent is hereby corrected as shown below:

Title page,
Item [56], References Cited, please add the following references:

-- 4,866,351, dated 9/1989, Inventor Yazaki, Class 315, Sub-Class 39X
5,886,479, dated 3/1999, Inventor Kennedy et al., Class 315, Sub-Class 39
5,446,426, dated 8/1995, Inventor Wu et al., Class 333, Sub-Class 125 --.

Signed and Sealed this

Twenty-sixth Day of November, 2002

*Attest:*

*Attesting Officer*

JAMES E. ROGAN
*Director of the United States Patent and Trademark Office*